US005086639A

United States Patent [19]

Wallman

[11] Patent Number: 5,086,639

[45] Date of Patent: Feb. 11, 1992

[54] ARRANGEMENT FOR CARRYING OUT PRESSING IN ECCENTRIC PRESSES

[76] Inventor: Lennert K. O. Wallman, Harstenagatan 2, S-582 73 Linkoping, Sweden

[21] Appl. No.: 640,317

[22] PCT Filed: Jun. 20, 1990

[86] PCT No.: PCT/SE90/00440

§ 371 Date: Jan. 31, 1991

§ 102(e) Date: Jan. 31, 1991

[87] PCT Pub. No.: WO91/00174

PCT Pub. Date: Jan. 10, 1991

[30] Foreign Application Priority Data

Jul. 5, 1989 [SE] Sweden ..... 8902435

[51] Int. Cl.[5] ..... B21D 37/00

[52] U.S. Cl. ..... 74/455; 72/465; 100/258 A; 100/231

[58] Field of Search ..... 100/214, 258 R, 258 A, 100/231; 73/455, 465

[56] References Cited

U.S. PATENT DOCUMENTS 3,362,322 1/1968 Moehlenpah ..... 100/231
3,991,602 11/1976 Harcuba et al. ..... 100/231
4,016,742 4/1977 Shiokawa ..... 72/465

FOREIGN PATENT DOCUMENTS 554810 6/1932 Fed. Rep. of Germany ..... 100/231
304448 3/1955 Switzerland ..... 72/465
1186327 10/1985 U.S.S.R. ..... 72/465
2117306 10/1983 United Kingdom ..... 100/231

*Primary Examiner*—David Jones
*Attorney, Agent, or Firm*—Nilles & Nilles

[57] ABSTRACT

In a method and an arrangement for pressing in a C-frame press, in which the press slide (5) is slightly inclined as a result of resilience in the frame (4) of the press at the pressing moment, wherein the effective slide movement is slightly shorter at the one side of the slide than at the opposite side, a plate-shaped spring member (28) is arranged under the press slide, which spring member is compressed by the force from the slide to a lesser extent at the firstmentioned side of the slide, as a result of which the inclination ($\alpha$) of the slide is compensated and the useful slide movement is identical or approximately identical on both sides. The spring member is preferably secured with pre-compression between the press slide and an upper part (22) of the tool (2) which is used in the pressing.

7 Claims, 3 Drawing Sheets

ARRANGEMENT FOR CARRYING OUT PRESSING IN ECCENTRIC PRESSES

FIELD OF INVENTION

The present invention relates to a method and an arrangement for carrying out pressing in the type of eccentric press which has a C-shaped frame. Such a press is illustrated in FIG. 1.

BACKGROUND OF THE INVENTION

In the open front part of the press, where the pressing work is carried out, there is a horizontal table 1 on which a press tool 2 is arranged and at the opening 3, which the frame 4 forms above the table, the press has a slide 5 which is guided in the vertical direction in such a way that it can be displaced towards and from the press table. In its displacement downwards towards the table 1, the slide transmits the force P, necessary for the pressing work, to the tool and the workpiece which is inserted therein and is to be reshaped.

The force from the press slide 5 has the result that the frame 4 upon each such working stroke undergoes a small elastic deflection, followed by a spring-back movement when the slide turns and moves upwards. At the same time as the frame 4 is deflected, the opening 3 is widened slightly upwards, which thus takes place just at that moment in the cyclical operation when the pressing work is being performed. This unavoidable situation in C-frame presses is well known to those skilled in the art. It is usually said that the press is "yawning".

At the moment when the press "yawns", the slide 5 does not move exactly linearly to and from its turning-position, but instead, as a consequence of the deflection and spring-back of the frame 4, the direction of the slide relative to the press table 1 varies slightly in such a way that a small angular movement outwards and inwards can be observed. In FIG. 2, which shows diagrammatically the movement at the pressing moment, this angular variation is designated by $\alpha$, the line 6 is the ideal direction of a central plane in the slide 5, in which plane the force P acts and along which plane the slide is intended to move at right angles to the press table 1, whereas the line 7 is the inclined position (shown exaggerated) which the slide plane 6 assumes at the moment when the force P has reached its maximum, that is to say when the "yawning" is at its greatest.

When the slide movement is transmitted in a conventional manner to the tool 2 and the workpiece in the latter, the inclination $\alpha$ has the result that the useful or effective part of the working stroke, that is to say the slide movement downwards towards the press table 1 corresponding to the reshaping of the workpiece, is not equal at different points along a transverse horizontal plane, for example the plane 8 in FIG. 2. As the figure shows (again slightly exaggerated), the effective working stroke is less at the outer (in the figure right-hand) side 9 of the slide, the tool and the workpiece than at the central plane 6. The working stroke or the press depth increases successively along the broken line 10 from the said side to the inner opposite side 11 where the generated press depth $S_2$ is greatest. The full line 12 is intended to represent the desired turning-position which should guarantee a constant press depth amounting to $S_2$ over the whole plane 8.

The variation in press depth, which is represented in FIG. 2 by lines 10 and 12 and which occurs in all work on a C-frame press according to previously known technology, is the same or essentially the same in each plane which is perpendicular to the central plane 6, that is to say parallel to the abovementioned lines. There is thus no difference or only a slight difference in the press depth at various points along the central plane or another plane parallel to it. However, in the case of a frame which has a design other than that shown in principle here, or in the case of a certain tool construction, it is possible for the maximum difference $S_2$-$S_1$ in the press depth to occur in a direction which is not perpendicular but instead oblique relative to the central plane 6, in which respect each arbitrary line which connects points of the same press depth correspondingly crosses obliquely over the press table.

It will be understood from the above that the inclination of the slide, which occurs at the pressing moment, results in considerable shaping errors in the pressed components. The shaping errors are often unacceptably great, in particular in the case of components which take up a large part of the size of the press table in the transverse direction, that is to say in the direction 9-11. An example of such components is blades forming part of fan wheels which are to have an arched cross-profile, identical along the whole blade length. In FIG. 3 the full lines indicate the desired cross-section of such a blade. Since, for industrial engineering reasons, the longitudinal direction of the workpiece introduced into the press tool coincides with the direction of the line 10, the profile depth in the pressed component decreases in the direction towards the outside 9 of the tool to the same extent as the working stroke decreases along this line. The cross-section of the finished blade can, at the outer (right-hand) end, have the appearance which is shown diagrammatically in the figure by broken lines. An error of this type can lead to problems when assembling the fan wheel and can also mean that the performance of the fan is poorer than when the blades have a correct, constant cross-section.

Another problem caused by the inclination is illustrated in FIG. 4, in which 13 designates a die tool comprising a die 14 which, upon pressing of a hole in a sheet blank 15, moves downwards into an opening 16, adapted exactly to the die, in the counter-die 17 of the tool.

If in this case too there is an error in the direction of the die 14, as shown by inclination angle $\alpha$, the outer (in the figure right-hand) edge of the die, upon its movement downwards into the counter-die, strikes against the latter in the upper part of the opening 16 where it meets the counter-die at 18, with the consequence that the tool here undergoes significant wear, which considerably shortens its lifetime. The problems which result from inclination of the slide can only be partially counteracted by using a larger press with a stronger frame than is required for the pressing work, and this is economically disadvantageous. The alternative of going over to another type of press, so called 2- or 4-column presses, where no "yawning" occurs, is even more disadvantageous. On the one hand, the initial outlay for such presses is higher than for the C-frame press, and, on the other hand, the pressing work cannot be carried out at the same high rate on account of the fact that the space is limited by the columns.

SUMMARY OF THE INVENTION

The aim of the present invention is, while retaining the good characteristics of the C-frame press, to attempt to overcome the disadvantages which arise when working on such a press as a result of the elastic resilience of the frame. The invention is based on the understanding that this resilience, and the inclination of the slide which the resilience causes, cannot be eliminated, but instead it is a question of finding measures and arrangements in order to compensate for the inclination during the pressing work.

The method according to the invention is characterized in that a plate-shaped spring member is inserted in a transverse plane under the slide, which spring member is compressed by the force from the slide during the pressing moment to a lesser extent at the said first side than at the said second side, so that the inclination of the slide is compensated by the spring member, and the useful slide movement is identical or approximately identical on both sides. The spring member is advantageously held fixed between the press slide and an upper part of the tool which is used in the pressing, preferably firmly secured on the end plane of the slide facing towards the tool.

An arrangement for pressing in so-called gap-frame presses and the like, comprising a frame with a press table and a slide which can be displaced in the frame towards and from the press table and which, upon its displacement downwards towards the press table, transmits the force necessary for the pressing to a tool arranged on the press table, wherein the slide, as a result of resilience in the frame, is inclined slightly so that the effective slide movement at the pressing moment is slightly shorter at a first side of the slide and the tool than at an opposite second side, is characterized according to the invention in that it comprises a plate-shaped spring member which is designed to be arranged in such a way along a plane transverse to the displacement direction under the slide, that the force from the slide attempts to compress the spring member, and which spring member is designed to exert at the said first side a greater resistance per surface unit against the compression than at the said second side, as a result of which the inclination of the slide is compensated and the slide movement transmitted to the tool is identical or approximately identical on both sides.

BRIEF DESCRIPTION OF THE DRAWINGS

The invention will now be described in greater detail with reference to the attached drawing in which, as has been described above.

FIG. 5 is a section of the arrangement in a vertical plane in the same direction as the side view in FIG. 1 through the lower part of the slide of the press and a tool arranged underneath, and FIG. 6 is a perspective view of the same arrangement. FIGS. 7–10 show perspective views of variants of the arrangement according to FIGS. 5–6. Previously described parts have the same references as in FIG. 1.

DETAILED DESCRIPTION OF THE PREFERRED EMBODIMENTS OF THE INVENTION

Figure 1:
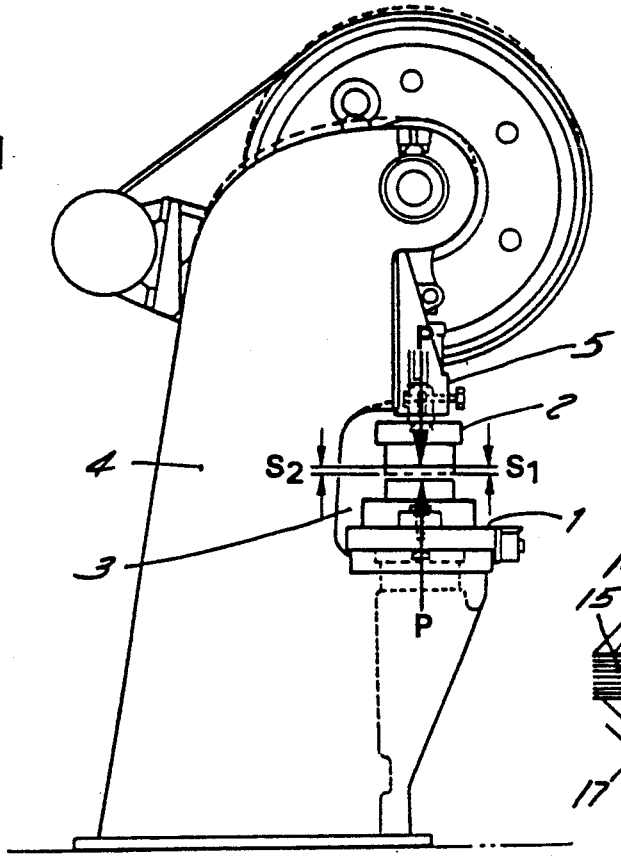
FIG. 1 is a side view of a known eccentric press.
Figure 4:
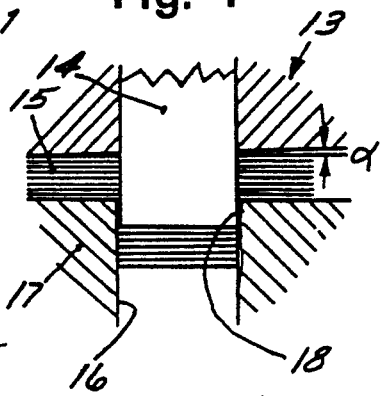
FIG. 4 is a partial section of a die tool in operation according to known technology.
Figure 2:
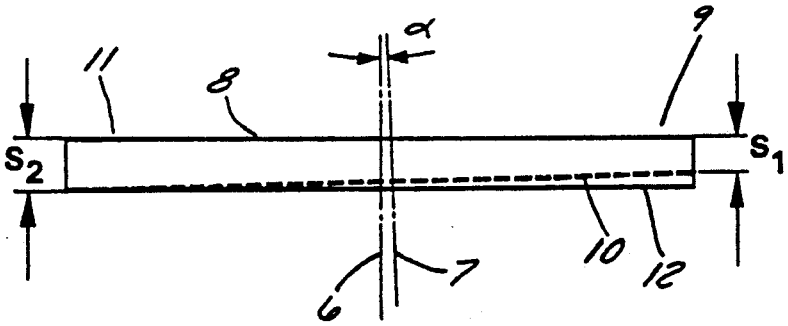
FIG. 2 shows the variation in the press depth in the direction outwards from the frame of the press.
Figure 3:
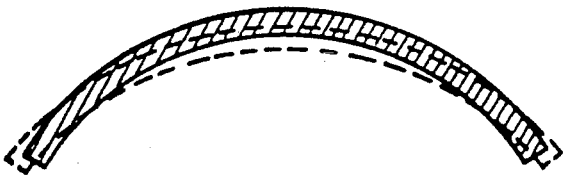
FIG. 3 shows the deviation in the cross-profile of a fan blade on account of this variation.
Figure 5:
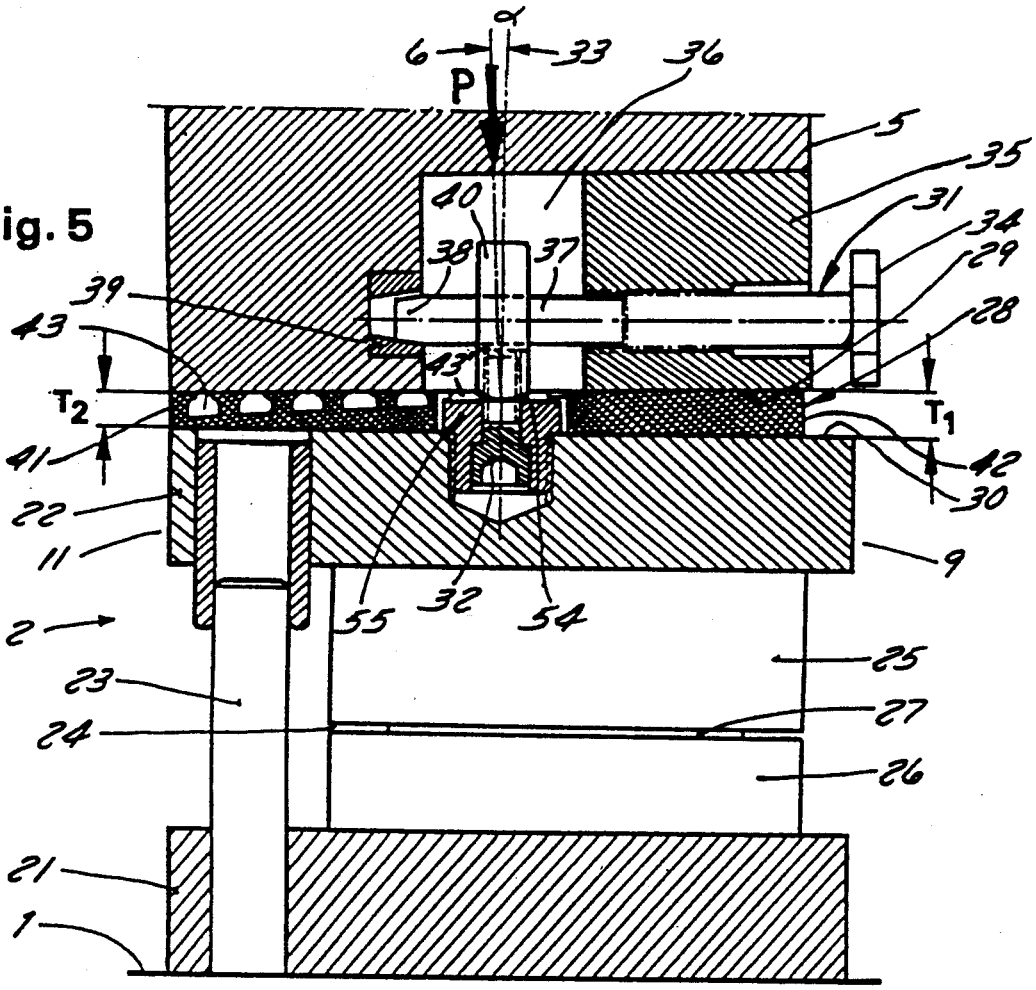
FIGS. 5–10 show the arrangement according to the invention in various embodiments, in which respect

In FIG. 5 the tool 2 is designed as a column die set with a lower part 21 which is secured on the press table 1, and an upper part 22 which will be fixed to the lower part of the slide 5 of the press. The said two tool parts are guided mutually by means of columns 23. In a space 24 extending horizontally between the die part 25 of the tool and a bending die 26, there is a blank 27 which is assumed to be a strip plate, from which a blade with a cross-profile according to FIG. 3 is to be shaped. It is furthermore assumed that the blank is introduced at right angles to the plane of the drawing and that the blank, upon bending in the tool, has its longitudinal direction parallel to the same plane, that is to say at right angles to the outer and inner sides 9 and 11 of the tool.

According to a main characteristic of the invention, the arrangement comprises a plate-shaped spring member, generally designated 28 in the drawing, which shall transmit the force (P) upon pressing and shall therefore be arranged under the slide 5 in a plane transverse to its plane of movement 6. In the exemplary embodiments shown, the spring member is a an unequally compressible body or plate, preferably of rubber or similar elastic material, whose basic form is rectangular and which essentially has the same width and length as the downward-facing end surface 29 of the slide 5 and the upward-facing delimiting surface 30 of the upper part 22 of the tool.

Figure 6:
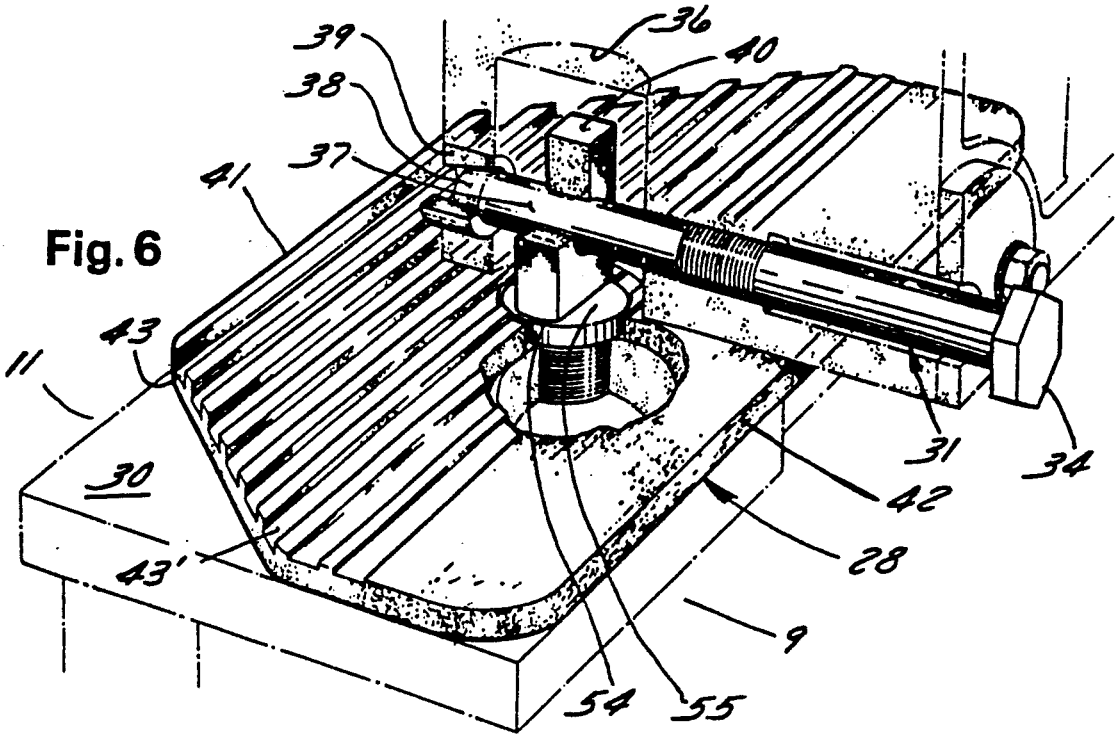

As shown in FIGS. 5 and 6, the spring member 28 is arranged symmetrically relative to the plane of movement 6 of the slide, preferably between the two surfaces 29 and 30 just mentioned, in which position it can be fixed by means of a tightening arrangement 31 in cooperation with a part 32 which is anchored at the upper part of the tool 2 and in the form of a threaded tap projects up out of it along a vertical plane 33. As an alternative to this position between slide and tool, the spring member 28 can be built into the tool, arranged horizontally between two parts which can mutually move vertically as a consequence of the force P, or in a corresponding manner arranged under the tool or in the press table 1.

The tightening arrangement 31 comprises an adjusting screw 34 which is threaded into a block 35 which can be introduced from the outside of the slide and on whose inside there is a hollow space 36. The adjusting screw extends through the latter and in this part is turned to a cylindrical pin 37 and a conical end 38. The latter is introduced, during assembly, into a conically bored-out bushing 39 which is pressed slightly higher up into the material of the slide. The conical end of the adjusting screw therefore acquires a bearing on the bottom of the bushing, and the more the screw is tightened inwards, the more its pin 37 is adjusted upwards during deflection. A yoke 40 belonging to the tightening arrangement, which yoke has a hole matching the pin 37 and is threaded securely on the part 32, is clearly adjusted upwards along the vertical plane 33 when the adjusting screw is tightened. In this way it is possible to give the spring member a certain pre-compression against the surfaces 29 and 30 on the slide.

According to FIGS. 5–8 the spring member 28 is a plate of uniform thickness which, at its inner part situated nearest the frame of the press (in FIG. 5 to the left of the plane 33), is designed with a cell structure which shall give the plate a resiliency increasing in the direction towards its inner edge 41, while the remaining part of the plate, from the plane 33 to the opposite outer edge 42, is made solid.

In the embodiment according to FIGS. 5-6, the cell structure has recesses 43' which are parallel to the said edges and whose depth varies, so that the recesses 41 nearest the middle of the plate are shallowest, from which point the recesses become deeper and deeper inwards towards the edge 41. In this way the spring member exerts, at its outer (right-hand) part, a greater resistance per surface unit to the force P from the press slide than at the inner part with cell structure, and the result is that, during the pressing moment, the inclination of the slide 5, which is shown as a difference between measurements $T_1$ and $T_2$ (FIG. 5), is compensated by the spring member 28. Thus, during pressing, the upper part 22 of the tool retains its parallel direction to the lower part 21, as a result of which the working stroke of the slide transmitted to the tool as desired is identical or approximately identical on both sides of the central plane 33. The blade blank 27 is therefore bent to the same depth along its whole length.

Figure 7:
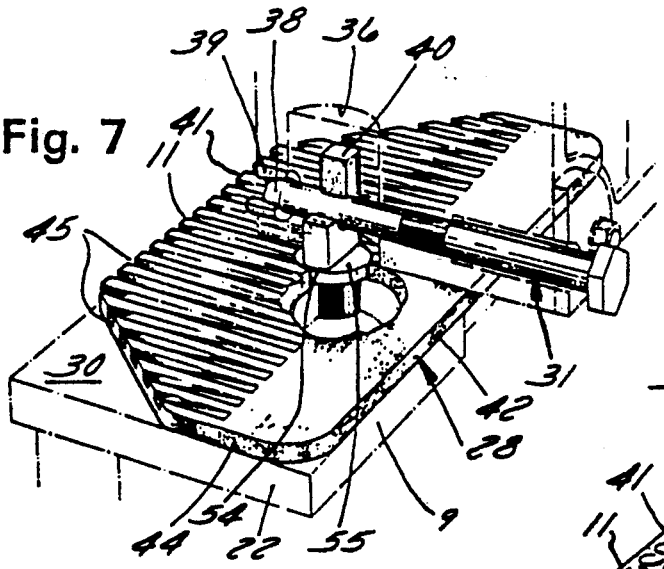
Figure 8:
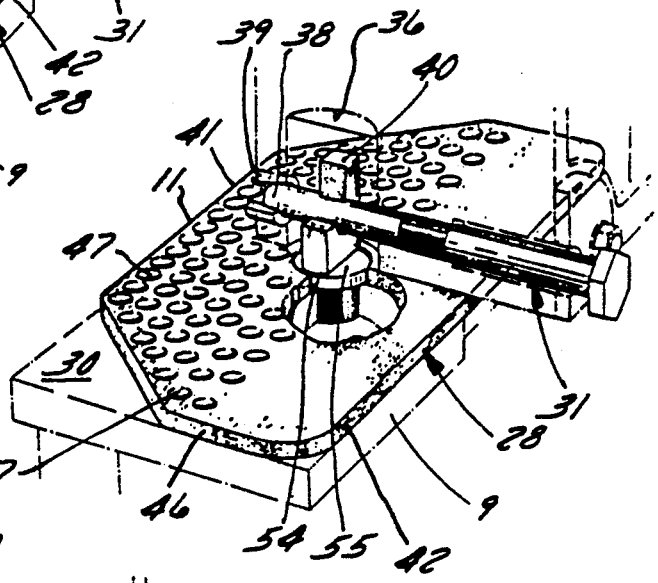

The cell structure of the spring member 28 can be formed in a number of different ways. FIG. 7 shows an alternative with a plane-parallel rubber sheet 44 which has grooves 45 running in the transverse direction. Each one of the grooves increases in depth towards the inside 11, where the structure is therefore at its weakest. The same spring function as in the first-described embodiment can also be obtained with a cell structure according to FIG. 8. Here, a sheet 46 is formed with holes 47 which are arranged sparsely in the middle of the sheet, while the holes are more and more densely arranged towards the inside 11.

Figure 9:
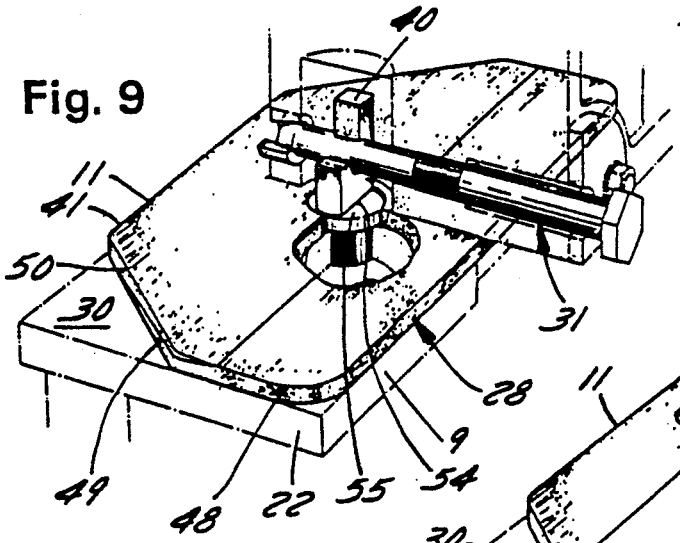
Figure 10:
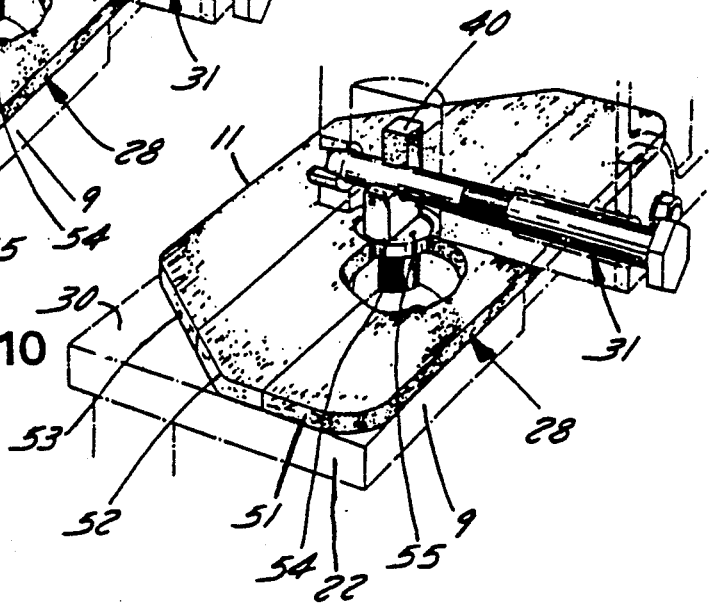

Two further alternative embodiments of the spring member are shown in FIGS. 9-10. In both cases a sheet of rubber elements of varying degrees of hardness is produced, in which respect one element 48 or 51 which has the highest degree of hardness acts as a spring in the outer part of the sheet.

In the embodiment according to FIG. 9 the same element is extended inwards to the edge 41, forming a wedge 49 which is vulcanized to a second element 50 which has a lower hardness and has the reverse wedge shape, so that the sheet becomes plane-parallel and is considerably softer in the direction towards the edge 41. The same effect can be obtained in accordance with FIG. 10 by welding together a number of elements 51-53 with degrees of hardness decreasing in the said direction.

According to a particular characteristic of the invention, the tightening arrangement 31 and the part 32 are connected to a hinge which facilitates the relative movement between the press slide 5 and the tool 2 which the spring in the member 28 assumes. The hinge is formed by means of the yoke 40 being cylindrically rounded at its lower side 54, as a result of which it can pivot in a rolling movement on a seat 55 which is threaded into the upper part 22 of the tool and prevents the part 32 from following upwards when the spring member 28 is precompressed. The construction allows the yoke 40 to move about an angle of similar size in this pivot hinge as the angle of inclination $\alpha$. By means of the fact that the yoke 40 and the seat 55 constantly hold the part 32 threaded therein, the last-mentioned two parts are subjected to a certain bending during the pressing work, as a result of which the hinge can also be said to constitute a bending centre for the angular movement which compensates for the inclination of the slide.

I claim:

1. In an arrangement for press forming a workpiece placed between upper and lower separable tool parts mounted in a press of the type having a C-shaped frame (4), first and second opposite sides (9,11), a press table (1) on said frame, and a slide (5) reciprocally mounted on said frame for movement downward toward and upward from said press table along a central plane (6), said downward movement of said slide at impact on the workpiece generating a force (P) which, as a result of the resiliency in said frame, causes said frame to deflect and create an angle of inclination ($\alpha$) of said slide relative to said central plane so that the effective movement of said slide at said first slide (9) is shorter than the effective movement of said slide at said second side (11), the improvement comprising:

a plate-shaped unequally compressible body (28) mounted in a transverse plane below said slide and having a plurality surface units located between said first and said second sides;

said unequally compressible body having a resistance to compression per surface unit that is greater at said first side than at said second side so that the compression of said body created by the force (P) at impact is less at said first side than at said second side to compensate for said angle of inclination ($\alpha$) caused by frame deflection whereby the slide movement that is transmitted to the tool at the impact is substantially identical at both of said first and second sides during tool impact on the workpiece.

2. The arrangement according to claim 10 wherein said slide has a downward facing end surface (29) and one of said tool parts has a delimiting surface (30) facing said end surface; and said unequally compressible body is mounted between said downward facing end surface and said delimiting surface.

3. The arrangement according to claim 2 wherein said unequally compressible body, when uncompressed, has spaced parallel upper and lower surfaces that extend coextensive with said downward facing end surface and said delimiting surface.

4. The arrangement according to claim 2 further comprising:

a connecting means mounted in said one tool part to project from said delimiting surface; and a tightening arrangement (31) that is arranged to be in engagement with said connecting means for moving said one tool part and said body toward said slide upon tightening of said tightening arrangement, so that said body is fixed with respect to said two surfaces.

5. The arrangement according to claim 4 wherein said tightening arrangement and connecting means are connected together to form a hinge (54) having a pivot axis extending parallel to said downward facing end surface and said delimiting surface; said pivot axis allowing relative angular movement between said tightening arrangement and connecting means to a degree that is at least equal to said angle of inclination ($\alpha$) of said slide.

6. The arrangement according to claim 1 wherein said unequally compressible body comprises a plate of uniformly thick elastic material having an intermediate zone between said first and second sides, said material having the same degree of compressibility over its entire extent;

said plate of elastic material having a plurality of recesses forming a cell structure therein which provides said plate, when subjected to said force (P), with a variable compressibility that increases from said intermediate zone toward said second side in proportion to said angle of inclination ($\alpha$) of said slide.

7. The arrangement according to claim 1 wherein said unequally compressible body comprises a plurality of elements of elastic material, each of which has a different degree of compressibility, said elements joined together to form a flat plate of uniform thickness having an intermediate zone between said first and second sides;

said element with the lower degree of compressibility being located adjacent said first side and said remaining elements of higher degrees of compressibility located between the intermediate zone and said second side to provide said plate with a variable compressibility that increases from intermediate zone of said plate toward said second side in proportion to said angle of inclination ($\alpha$) of said slide.

* * * * *